US006564719B2

(12) United States Patent
Saxby

(10) Patent No.: US 6,564,719 B2
(45) Date of Patent: May 20, 2003

(54) TRAINING CARTRIDGE FOR A SELF LOADING GUN

(75) Inventor: Michael Ernest Saxby, East Sussex (GB)

(73) Assignee: Lambeth Properties Limited, Nassau (BS)

( * ) Notice: Subject to any disclaimer, the term of this patent is extended or adjusted under 35 U.S.C. 154(b) by 0 days.

(21) Appl. No.: 10/017,421

(22) Filed: Dec. 13, 2001

(65) Prior Publication Data

US 2002/0162475 A1 Nov. 7, 2002

Related U.S. Application Data

(63) Continuation-in-part of application No. 09/479,470, filed on Jan. 10, 2000, now Pat. No. 6,415,718.

(30) Foreign Application Priority Data

Aug. 27, 1999 (GB) ..... 9920205

(51) Int. Cl.[7] ..... F42B 8/00
(52) U.S. Cl. ..... 102/446
(58) Field of Search ..... 102/443, 444–447, 102/469, 470

(56) References Cited

U.S. PATENT DOCUMENTS

| | | | | |
|---|---|---|---|---|
| 3,477,375 | A | 11/1969 | Barr | 102/45 |
| 3,528,662 | A | 9/1970 | Merchant et al. | 273/106.5 |
| 3,577,923 | A | 5/1971 | Perkins et al. | 102/46 |
| 3,611,939 | A | 10/1971 | Stadler et al. | 102/46 |
| 3,713,386 | A | 1/1973 | Zaid | 102/38 |
| 3,782,286 | A | 1/1974 | Jones et al. | 102/41 |
| 3,837,284 | A | 9/1974 | Waldeisen | 102/92 |
| 3,952,662 | A | 4/1976 | Greenlees | 102/92.7 |
| 4,128,059 | A | 12/1978 | Black | 102/92.7 |
| 4,204,474 | A | 5/1980 | Mizelle | 102/92.7 |
| 4,440,062 | A | 4/1984 | McQueen | 89/128 |

(List continued on next page.)

FOREIGN PATENT DOCUMENTS

| | | | |
|---|---|---|---|
| GB | 620426 | 3/1949 | |
| GB | 1263522 | 2/1972 | F42B/11/18 |
| GB | 1309362 | 3/1973 | F42B/11/10 |
| GB | 1371482 | 10/1974 | F42B/11/10 |
| GB | 2284252 A | 5/1995 | F42B/12/40 |
| GB | 2 313 656 A | 12/1997 | F41C/27/00 |
| WO | WO 87/05384 | 9/1987 | F41C/11/06 |
| WO | WO 91/14916 | 10/1991 | F42B/8/04 |
| WO | WO 95/05573 | 2/1995 | F42B/6/10 |
| WO | WO 98/41810 | 9/1998 | F42B/5/02 |

*Primary Examiner*—Charles T. Jordan
*Assistant Examiner*—Kimberly S. Smith
(74) *Attorney, Agent, or Firm*—Lahive & Cockfield, LLP

(57) ABSTRACT

A cartridge for use in non-lethal applications comprising an anterior portion and a posterior portion, the posterior portion comprising a recycling mechanism including a moveable member in the form of a piston or cylinder, slideably engaged respectively with a cylinder or a piston, gas generating means for providing gas within the cartridge, the gas generating means being initiatable by the primer on firing of the firearm to propel the moveable member in a rearward direction against the breech block so as to recycle the firearm, the anterior portion having a gas passage therethrough and being provided with a nose portion which is suitable for receiving a projectile; an expansion chamber being provided between the moveable member and the anterior portion, a source of energetic material located in the anterior portion forward of the gas channel, a percussion means of cross sectional dimension slightly smaller than the gas channel and moveable therein the energetic material being initiatable by a shock or pressure wave produced on activation of the primer, which in turn propels the percussion means to strike against the energetic material causing initiation, thereby to cause propulsion of the projectile from the cartridge.

5 Claims, 4 Drawing Sheets

U.S. PATENT DOCUMENTS

| | | | | |
|---|---|---|---|---|
| 4,515,064 | A | 5/1985 | Hobrein | 89/128 |
| 4,637,616 | A | 1/1987 | Whiting | 273/418 |
| 4,686,905 | A | 8/1987 | Szabo | 102/444 |
| 4,823,702 | A | 4/1989 | Woolsey | 102/502 |
| 5,016,536 | A | 5/1991 | Brighton | 102/430 |
| 5,046,275 | A | 9/1991 | Brown | 42/25 |
| 5,221,809 | A | 6/1993 | Cuadros | 102/439 |
| 5,677,505 | A | 10/1997 | Dittrich | 89/14.5 |
| 6,095,051 | A | 8/2000 | Saxby | 102/444 |
| 6,178,889 | B1 | 1/2001 | Dindl | 102/447 |

TRAINING CARTRIDGE FOR A SELF LOADING GUN

This application is a Continuation-in-Part of U.S. patent application Ser. No. 09/479,470, filed on Jan. 10, 2000, now U.S. Pat. No. 6,415,718 B1, which claims priority to Great Britain Patent Application Serial No. 9920205.3, filed on Aug. 27, 1999. The contents of the aforementioned applications are hereby incorporated by reference.

BACKGROUND OF THE INVENTION

The present invention relates to ammunition, particularly non-lethal ammunition intended for use in training or war games. More especially the invention relates to a telescopic cartridge in which rearwards movement of a portion of the cartridge is used to initiate the recycling of an automatic or semi-automatic firearm.

One form of cartridge of the above type is shown in FIG. 1 and is the subject of co-pending GB Patent Application 9819928.4, the contents of which are hereby incorporated by reference.

Cartridges of the type described above are suitable for use both in the firing of blanks and projectiles for the purposes of simulating warfare. Simulation may be for training purposes or for recreation. Whilst this cartridge has overcome many of the problems suffered by its predecessors, in providing a feel similar to that of a lethal loaded cartridge, it has some drawbacks in the accuracy and repeatability of its performance.

A disadvantage of the previously known cartridges is due to their reliance on a single source of high pressure gas which performs both the objectives of propelling the projectile from the gun and cycling the guns reloading mechanism. The dividing of the gas to perform these two objectives cannot be carried out precisely due to engineering mechanical tolerances associated with the cartridge components. Whilst the gas provided by a primer is generally consistent due to sophisticated manufacturing techniques, for some types of cartridge a single primer does not provide sufficient energy to perform these two objectives safely and reliably.

It is an object of the present invention to provide a cartridge for use with firearms in warfare training and simulation exercises which can go some way to alleviating these disadvantages.

SUMMARY OF THE INVENTION

In accordance with the present invention there is provided a cartridge for use in non-lethal applications comprising an anterior portion and a posterior portion, the posterior portion comprising a recycling mechanism, the recycling being initiated on activation of a primer and the anterior portion being provided with a nose portion which is suitable for receiving a projectile, characterised by a source of energetic material being initiatable by a reaction produced on activation of the primer to cause propulsion of the projectile from the cartridge.

The energetic material source provided toward the anterior end of the cartridge can conveniently be initiated by the shock or pressure wave associated with propellant gases used to propel a moveable member against the breech block. The energetic material can be chosen according to its pyrotechnic qualities to additionally provide a noise reminiscent of any chosen lethal ammunition. Optionally, the energetic material may also produce a visual effect such as a flash of colour to simulate a lethal projectile exiting the firearm. Preferably, the energetic material is a non-toxic primer, this renders the cartridge more environmentally friendly and safer to use.

Thus the present invention provides two independent energetic sources, one to initiate the cycling of the reload mechanism and the other to propel a projectile from the casing. By separating the energetic sources in this manner a more predictable response can be produced on repeated firings of the firearm using a cartridge according to the present invention. The feedback to the user on firing such a cartridge is more realistic of a typical feedback response from a lethal cartridge.

A typical cartridge according to the present invention will comprise a posterior portion which has a moveable member which is slideable rearwardly towards a breech block, the anterior portion having a gas passage therethrough; an expansion chamber being provided between the moveable member and the anterior portion, and gas generating means for providing gas within the cartridge, the gas generating means being initiatable on firing of the firearm to propel the moveable member in a rearward direction so as to recycle the firearm. The energetic material is positioned forward of the gas passage and may be initiated by any suitable reaction caused on initiation of the primer. For example, the shock or pressure wave generated on activation of the primer may be sufficient to initiate the energetic material, or alternatively, activation of the primer may activate a secondary mechanical or electrical device which serves to initiate the energetic material.

The energetic material can be chosen to suit the size, mass and desired velocity of the projectile on firing. Different requirements may be met using different energetic materials or different quantities of the same energetic material.

In certain embodiments, the moveable member may be provided in the form of a piston or cylinder slideably engaged respectively with a cylinder or a piston. Preferably in these embodiments, the moveable member is in the form of a piston slideably engaged respectively with a cylinder.

The energetic material may be positioned either in association with the moveable member or separately in the anterior portion of the casing.

As an additional safety precaution, the cartridge may, optionally be provided with a peripheral fire primer, such as is known from GB Patent Application 0002767.2, the contents of which are hereby incorporated by reference.

In these embodiments, the primer typically takes the form of a cup or "can" which is set into the rear end of the cartridge. The cup typically has a hollow peripheral rim in which the primer material is located, the primer material being in a compressed state and highly sensitive to shock. The primer material can thus be detonated when the peripheral rim of the can is impacted by a firing pin. This arrangement is in contrast to conventional live rimfire cartridges (ie 0.22" calibre) in which the primer material is located in the rim of the cartridge itself rather than the peripheral rim of a cup set into the rear of the cartridge.

BRIEF DESCRIPTION OF THE DRAWINGS

In order to further explain the invention, a description of one embodiment of the invention is now given with reference to the Figures in which.

DESCRIPTION OF THE PREFERRED EMBODIMENT

Figure 1:
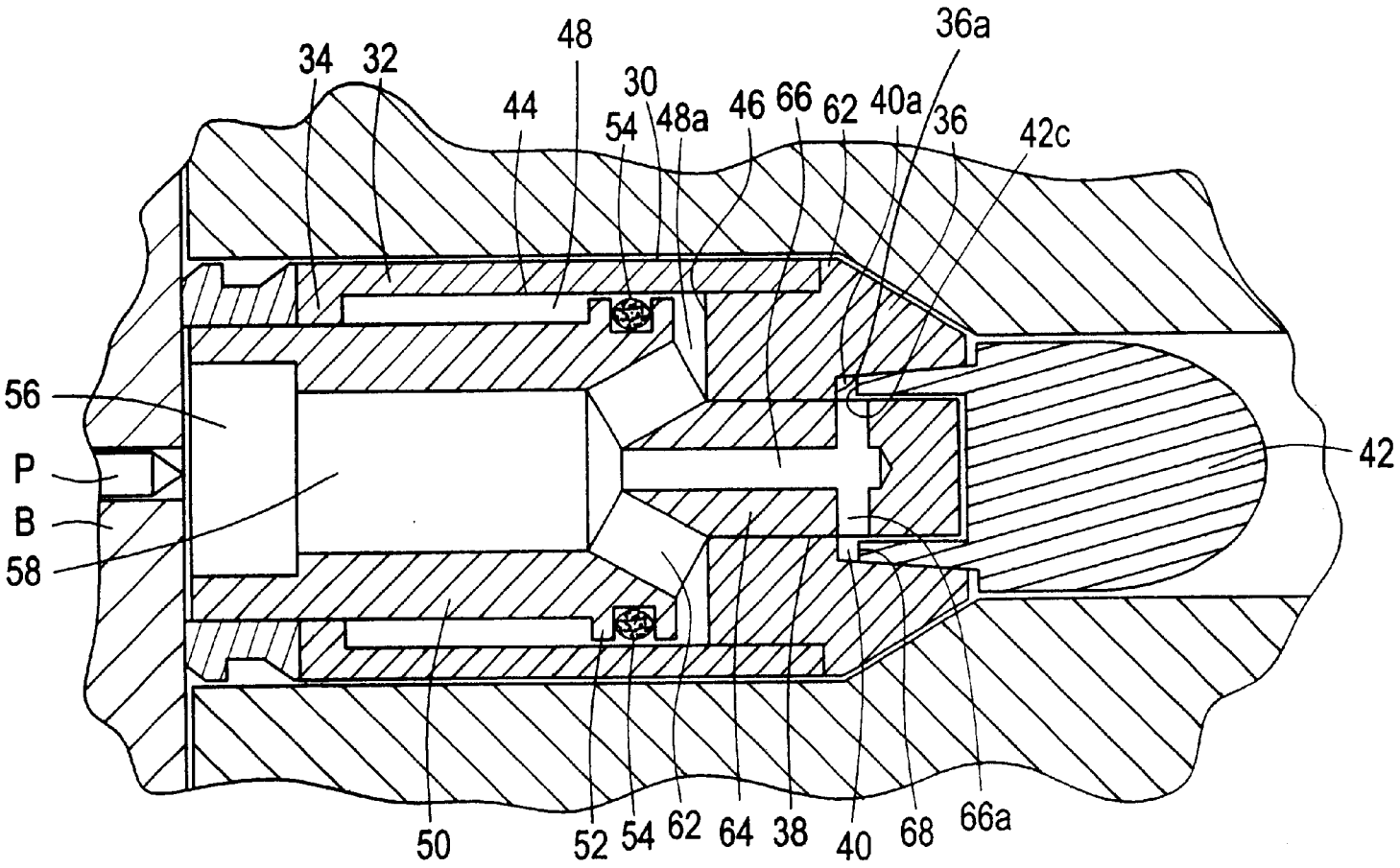
FIG. 1 PRIOR ART
FIG. 1 shows a prior art cartridge of the type described in GB Application No. 9819928.4.

In FIG. 1, a gun cartridge 30 comprises a cylindrical cartridge case 32 with an in-turned flange 34 at the rearward end. The forward end casing comprises a nose portion 36, which in this embodiment is in the form of a plug, from which sleeve 44 extends in a rearwards direction. The plug 36 has an axial bore or gas passage 38, the axial bore being stepped so that the larger diameter forward section 40 of the bore 38 forms a recessed seat in which is received the trailing end of a bullet 42.

The inner surface of the sleeve and the rearward surface 46 of the plug define a piston chamber 48. A piston 50 is slideably contained within the piston chamber 48 and has a pair of outwardly extending flanges 52 at its forward end. Nested between the flanges 52 and surrounding piston is an O-ring 54 to provide a seal between the forward end of the piston and the inner surface of the casing.

A pyrotechnic composition 56 is housed at the rearward end of the piston 50. Extending from the pyrotechnic composition to the forward end of the piston is a first gas expansion chamber 58. At the head of the gas expansion chamber 58, gas channels 62 allow the flow of propellant gas from the first expansion chamber 58 into the second expansion chamber 48*a* (which corresponds to the expansion chamber defined in the claims appended hereto), which is defined by the space between the piston head and the rearward surface 46 of the plug.

A spigot 64 extends from the forward end of the piston and is slideably contained within the axial bore or gas passage 38 of the plug The spigot has an axial gas passage 66 therethrough which provides a gas flow path from the gas first expansion chamber 58 via laterally extending passage 66*a* to outlets 68. Outlets 68 open out into the larger diameter forward section 40 of the bore 38 immediately behind the rear edge 42*c* of the hollow cylindrical skirt portion of the bullet 42. The annular space 40*a* formed between the rear edge 42*c* of the bullet, the outer wall of the spigot and the axially facing surface 36*a* of the plug functions as a third expansion chamber.

Figure 2A:
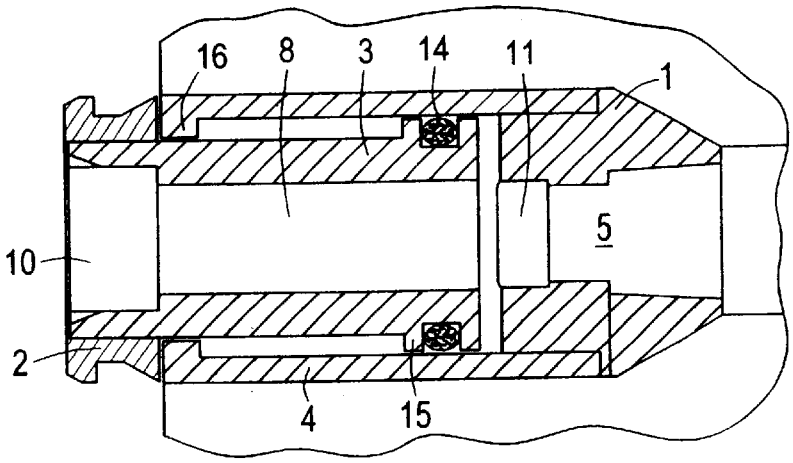
FIGS. 2A, 2B and 2C show one embodiment of the invention having a nose portion at the anterior end, the nose portion being suitable for receiving a projectile, the projectile being propellable on initiation of the energetic material.
Figure 2B:
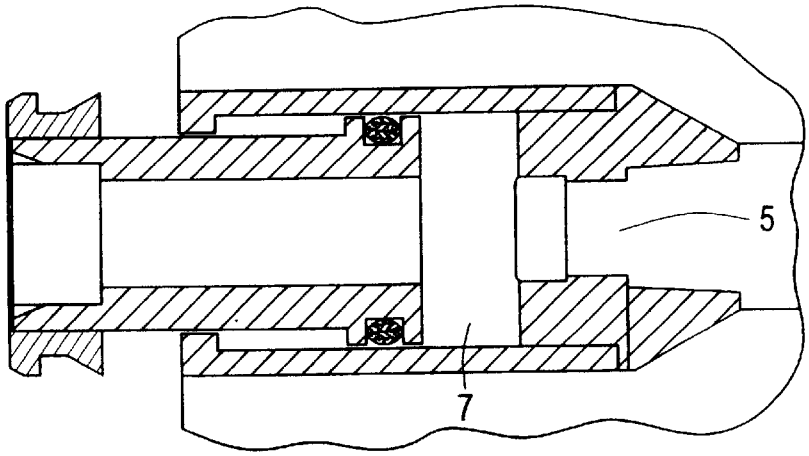
Figure 2C:
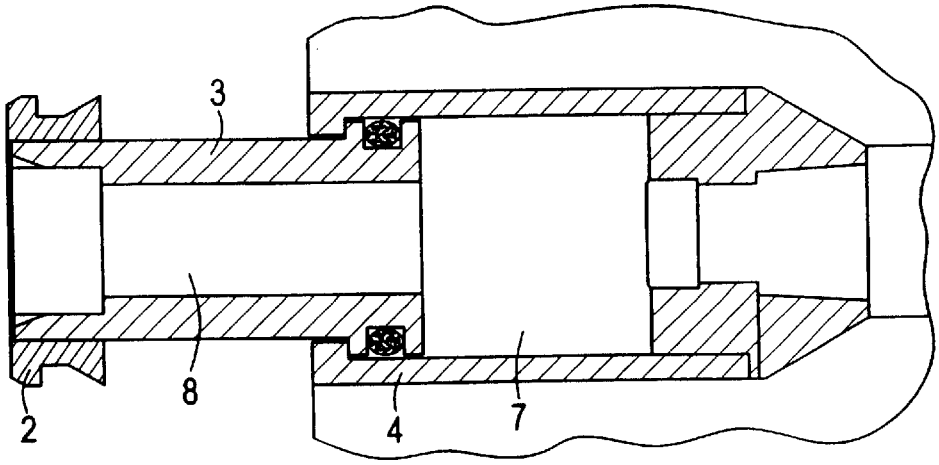

In operation, the pyrotechnic composition is activated by the firearm's firing pin P and the propellant gas produced expands into the first gas expansion chamber 58 and through the passage 66 in the spigot 64 to the third expansion chamber 40*a*, thereby discharging the bullet 42 from its seat. At substantially the same instant, gas flows through the gas channels 62 between the first gas expansion chamber 58 and the second expansion chamber 48*a* at the front of the piston. The pressurised gas forces the piston to move rearwardly relative to the outer casing 32, thereby urging the spigot 64 in a rearwards direction against the breech block B. As a result of the rearward displacement of the piston and spigot, the outlets 68 are substantially sealed by the inner surface of the axial bore 38 so preventing the flow of gas to the forward section of the bore 40 (see FIGS. 2A–C).

Consequently, the full force of the remaining propellant gas is directed through the gas channels 62 as the piston shoots backwards against the breech block to recycle the firearm. The flange 52 on the forward end of the piston engages with the flange 34 on the rearward end of the casing 32, therefore preventing further rearward motion of the piston and expulsion of the piston from the cartridge casing In FIGS. 2A–C a cartridge comprises an anterior portion 1 and a posterior portion 2 the posterior portion comprising a piston 3 slideable in a cylinder 4 extending rearwardly from the anterior portion 1. The anterior portion 1 is provided with a gas passage 5 which communicates with an expansion chamber 7. The piston 3 is provided with a hollow interior 8 which connects with expansion chamber 7.

Disposed toward the posterior end of the piston 3 is a first primer 10 and in the anterior portion there is a second primer 11.

A rubber sealing ring 14 is provided between the piston 3 and cylinder 4 to prevent passage of gas to the posterior portion 2. Adjacent the rubber sealing ring 14, the piston is provided with a rim of extended circumference 15, which, when the piston is allowed to extend from the cylinder, encounters a flange 16 provided on the inner circumference of the cylinder 4 to the posterior end of the cylinder 4.

In the embodiment of FIG. 2 the first primer 10 is initiated by, for example, a firing pin to produce a volume of gas. The gas travels along the hollow interior 8 and into expansion chamber 7. Expansion of the gas causes the piston 3 to slide rearwardly within cylinder 4 towards a breech block (not shown). The piston 3 is prevented from exiting cylinder 4 by the flange and rim (16, 15) provided respectively on the inner circumference of the cylinder 4 and piston 3. The shock/pressure wave created on ignition of first primer 10 initiates a second energetic response on second primer 11 located in the anterior portion 1 of the cartridge. The anterior portion 1 is provided with an internal profile suitable for receiving a projectile 17 The energetic reaction produced in primer 11 propels the projectile 17 from the cartridge at high speed to create the impression of a live bullet being fired. Thus it can be seen that recycling and firing of the projectile are controlled independently by two separate energetic reactions.

Figure 3:
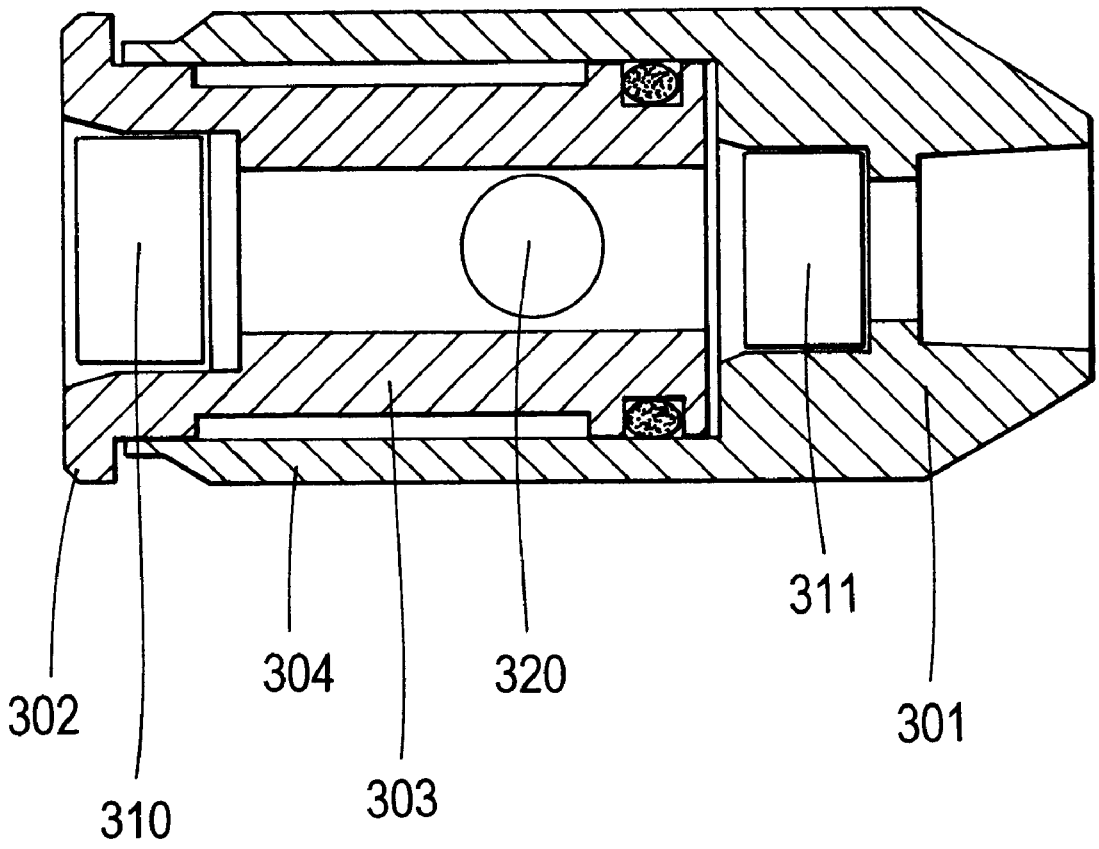
FIG. 3 shows an embodiment of the invention in which the energetic material in the anterior portion is initiated by mechanical means which mechanical means are propelled by a shock or pressure wave produced on initiation of the primer.

As can be seen, the embodiment of FIG. 3 consists of an anterior portion 301 and a posterior portion 302. The posterior portion comprises a piston 303 slideable in a cylinder 304 extending rearwardly from anterior portion 301. This embodiment recycles in much the same manner as that described in relation to FIG. 2. The main functional difference between the embodiments of FIGS. 2 and 3 is the provision of a percussion instrument in the form of a metal ball 320. The ball 320 is of diameter only slightly less than that of cylinder 304. As primer 310 is initiated, the associated pressure/shock wave propels the ball 320 at high speed towards energetic material 311. Since the shock and pressure wave associated with initiation of primer 310 travel faster than the gases which cause expansion of the chamber and recycling of the firearm, the ball 320 strikes the energetic material 311 before the chamber begins to expand. Also, the ball 320 acts at least in part to prevent escape of gases from the posterior 302 to the anterior portion 301 of the cartridge.

Figure 4:
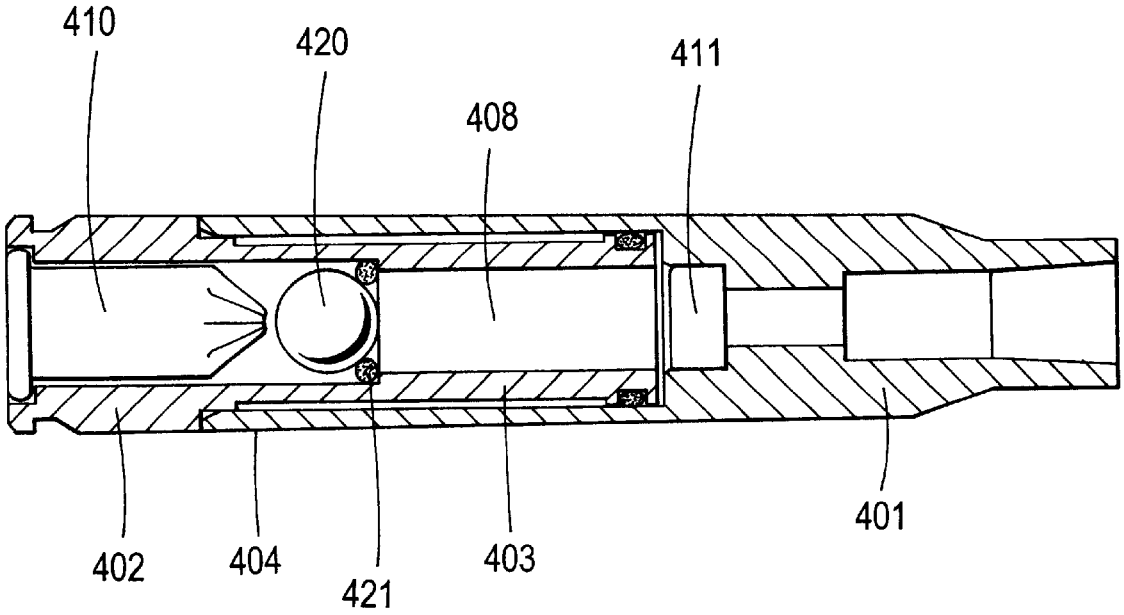
FIG. 4 shows an embodiment of the invention similar to the embodiment of FIG. 3 in which the primer in the posterior portion of the cartridge is provided in a peripheral rim rather than a central block as is shown in the embodiment of FIG. 3.

FIG. 4 illustrates another embodiment of the invention. This embodiment incorporates many of the features previously described in relation to the embodiments of FIGS. 2 and 3, including the anterior portion 401 and posterior portion 402, primer 410 and energetic material 411, piston 403 slideable in cylinder 404 and percussion ball 420. The main distinguishing feature of this embodiment is the provision of a rimfire bolt in place of a normal bolt, this prevents the firing of normal centre fire killing rounds during training or leisure activities. The rimfire bolt comprises the rim fire primer 410 which explodes to produce a pressure or sound wave which drives the percussion ball 420 through an O-ring 421 and towards front gas generating device 410, 411. On impact by the percussion ball 420, the gas generating device 411 explodes and generates a realistic bullet firing noise and/or propels a projectile from the cartridge.

The O-ring 421 comprises a flexible material which deforms under pressure. Hence, prior to firing, it acts to retain the percussion ball 420 in position towards the rear of the cartridge, and on firing deforms to permit acceleration of the percussion ball 420 through the bore 408 to impact and initiate the gas generating device 411 via primer 410.

In each of the embodiments of FIGS. 2 and 3, the percussion ball travels more quickly along the bore of the cartridge than the gas expands to cause expansion of the chamber. This ensures that a projectile can be ejected from the barrel before accuracy of the shot is disturbed by the recycling of the chamber.

It is to be understood that the foregoing is merely exemplary of two embodiments of the invention and that modifications can be made thereto without departing from the scope of the invention.

What is claimed is:

1. A cartridge for a firearm for use in non-lethal applications comprising an anterior portion and a posterior portion, the posterior portion including a recycling mechanism, the recycling mechanism including a moveable member in the form of one of a piston and a cylinder slideably engaged respectively with one of a cylinder and a piston, gas generating means for providing gas within the cartridge, the gas generating means being initiatable by a primer on firing of the firearm to propel the moveable member in a rearward direction against a breech block so as to recycle the firearm, the anterior portion having a gas passage therethrough and being provided with a nose portion which is suitable for receiving a projectile; an expansion chamber being provided between the moveable member and the anterior portion, a source of energetic material located in the anterior portion forward of the gas passage, a percussion means of cross sectional dimension smaller than the gas passage and moveable therein, the energetic material being initiatable by a shock or pressure wave produced on activation of the primer, which in turn propels the percussion means to strike against the energetic material causing initiation, thereby to cause propulsion of the projectile from the cartridge.

2. A cartridge as claimed in claim 1 wherein the moveable member is in the form of a piston slideably engaged respectively with a cylinder.

3. A cartridge as claimed in claim 1 wherein the percussion means is a metal ball.

4. A cartridge as claimed in claim 3 wherein the ball is retained in the posterior portion prior to firing by a flexible O-ring, the O-ring being deformable under load to permit passage of the ball into the gas passage.

5. A cartridge as claimed in claim 1 wherein the gas generating means is provided in the form of a substantially circular rim of primer.

* * * * *